United States Patent [19]

Russel et al.

[11] Patent Number: 5,026,034

[45] Date of Patent: Jun. 25, 1991

[54] DOCUMENT OUTPUT APPARATUS HAVING ANTI-DISHEVELMENT DEVICE

[75] Inventors: Steven M. Russel, Pittsford; Robert H. Shea, Victor, both of N.Y.

[73] Assignee: Eastman Kodak Company, Rochester, N.Y.

[21] Appl. No.: 368,685

[22] Filed: Jun. 19, 1989

[51] Int. Cl.[5] ..... B65H 39/00

[52] U.S. Cl. ..... 270/52; 271/211; 414/792.7; 270/58

[58] Field of Search ..... 270/52, 53, 58; 271/207, 220, 211; 414/788.1, 791.6, 792.7

[56] References Cited

U.S. PATENT DOCUMENTS

| | | | |
|---|---|---|---|
| 3,278,178 | 10/1966 | Eckl | 270/52 |
| 3,334,895 | 8/1967 | Daniels et al. . | |
| 4,033,579 | 7/1977 | Stange et al. . | |
| 4,189,133 | 2/1980 | Arrasmith et al. . | |
| 4,221,378 | 9/1980 | Kamath | 271/220 |
| 4,231,562 | 11/1980 | Hori . | |
| 4,575,067 | 3/1986 | Ciatteo | 270/58 |
| 4,611,741 | 9/1986 | Wilson . | |
| 4,611,800 | 9/1986 | Parsons et al. . | |
| 4,768,912 | 9/1988 | Miura | 414/792.7 |

FOREIGN PATENT DOCUMENTS

| | | | |
|---|---|---|---|
| 2317 | 6/1979 | European Pat. Off. | 270/58 |
| 2932286 | 2/1981 | Fed. Rep. of Germany | 414/792.7 |
| 63-235260 | 9/1988 | Japan | 270/37 |

*Primary Examiner*—Edward K. Look
*Assistant Examiner*—Therese M. Newholm
*Attorney, Agent, or Firm*—Tallam I. Nguti

[57] ABSTRACT

Apparatus for feeding and stacking sets of finished sheets in an electrostatographic copier or printer includes means for feeding a set of such sets one at a time onto the top of a stack of such sheets already in an output hopper, and an anti-dishevelment device for preventing the tearing, dishevelment and other damaging of the top sheet of the top set of the sets in the stack by contacting and holding down such top sheet during the feeding of a new set onto the top of the stack.

12 Claims, 3 Drawing Sheets

DOCUMENT OUTPUT APPARATUS HAVING ANTI-DISHEVELMENT DEVICE

This invention relates to document output devices, and more particularly to apparatus for feeding and stacking sets of finished sheets one at a time on top of others, without tearing, disheveling or otherwise damaging the top sheet of the top set of the sets already so fed and stacked.

In electrostatographic copiers and printers that produce or reproduce copies of documents on sheets of suitable receiving material, document output devices, as disclosed for example in U.S. Pat. No. 4,611,741, commonly stack stapled, bound or otherwise finished sets of such sheets one at a time on top of others for later removal by an operator.

A common problem associated with the stacking of such sets in this manner, regardless of how the sets are finished, is the tendency of the set being fed and stacked to tear, dishevel or otherwise damage the top sheet of the top set of the sets already in the stack. This problem is further complicated by limitations with respect to which edge or corner of the document sheets are, for example, stapled or bound for forming the set. In addition to this problem, conventional document output devices which usually are sensitive to the weight of the sets in a stack, require and consume a significant amount of power for performing such stacking. Furthermore, such conventional devices usually also include cumbersome adjustable stops for accommodating different size sheets being handled.

SUMMARY OF THE INVENTION

It is therefore an object of the present invention to provide an apparatus for feeding and stacking finished sheets in an electrostatographic copier or printer, one at a time on top of others, without tearing, disheveling or otherwise damaging sheets already in the stack.

More specifically, it is an object of the present invention to provide apparatus for feeding and stacking sets of finished sheets, one at a time on top of others, without tearing, disheveling or otherwise damaging the top sheet of the top set of sets already so fed and stacked.

It is a further object of the present invention to provide such an apparatus which requires relatively little power for performing such stacking.

It is yet another object of the present invention to provide a document output device that is simple and that does not include cumbersome ajustable stops for handling sheets of different sizes.

In accordance with the present invention, an apparatus for feeding and stacking sets of finished sheets in an electrostatographic copier or printer includes a receiving member for receiving and holding a stack of such sets. The apparatus further includes means for feeding a plurality of such sets, one at a time on top of the stack in the receiving member, and an anti-dishevelment device for preventing the tearing, dishevelment and other damaging of the top sheet of the top set in the stack by contacting and holding down such top sheet during the feeding of a new set onto such stack.

DESCRIPTION OF THE PREFERRED EMBODIMENT

Figure 1A:
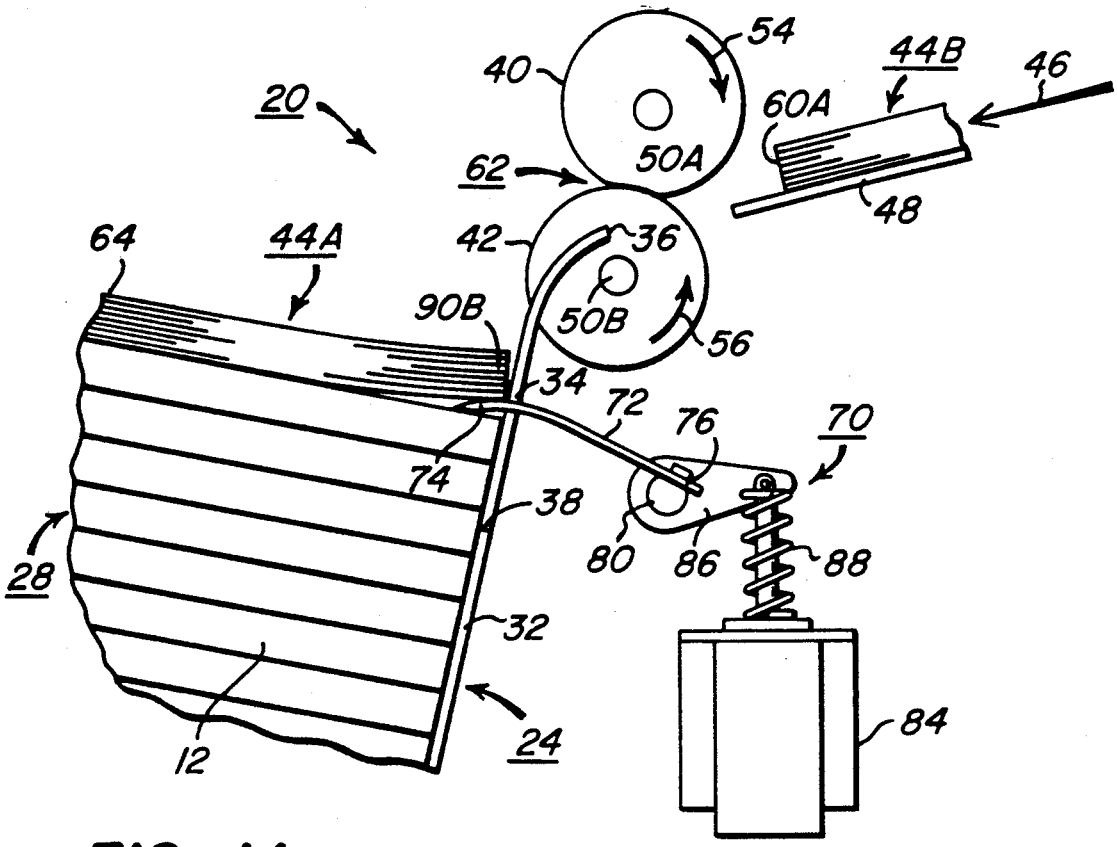
FIGS. 1A–D are partial schematic side views of the apparatus of the present invention illustrating its anti-dishevelment device.

Referring now to FIGS. 1A–D, an apparatus for feeding and stacking sets 12 of sheets is generally designated 20. The apparatus 20 is suitable for use in an electrostatographic copier or printer that produces or reproduces copies of documents on cut sheets, and that includes means such as a finisher for forming sets or booklets of such sheets by combining several of such sheets together. Such sets may be formed, for example, by stapling or binding the several sheets along a common edge.

As shown in the drawings, the apparatus 20 includes a sheet or set receiving member, such as a hopper 24, for receiving and holding such sets 12, one at a time on top of others, forming a stack 28. The hopper 24, which is only partially shown in FIGS. 1A–D, is generally rectangular, and includes a platform base 30 (FIG. 2) for holding the stack 28, and (left to right), a front end and a back end opposite the front end. The hopper 24 also includes an upwardly extending wall 32 that forms a stop at the back end of the hopper, and two other side walls (not shown), that are peripheral to the base 30. One side of the hopper 24, however, is open, or without a wall, in order to allow excess into, and removal of the stacked sets 12 of sheets from within the hopper. Upwardly extending wall 32, which forms the stop at the back end of the hopper, is thin, and includes a plurality of up and down slots 34 that each run from the top 36 thereof down to a point 38. As shown, the top 36 of wall 32 may be slightly curved outwards from the inside of the hopper.

Figure 1B:
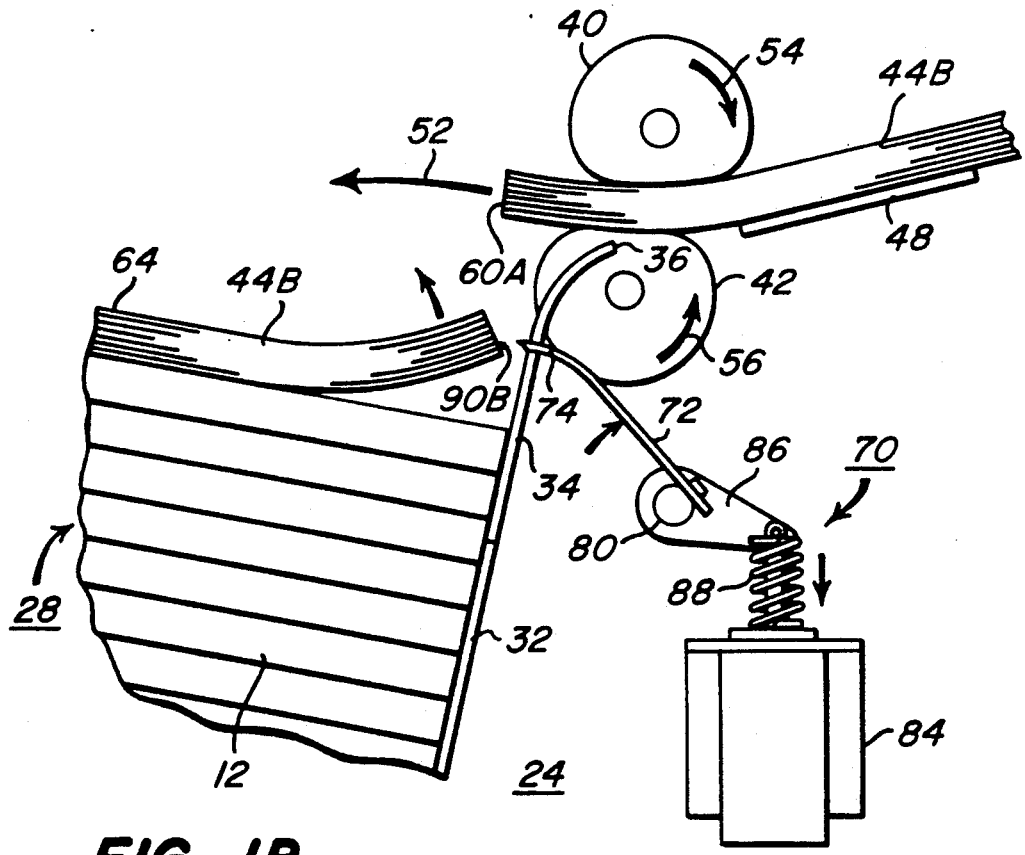
Figure 1C:
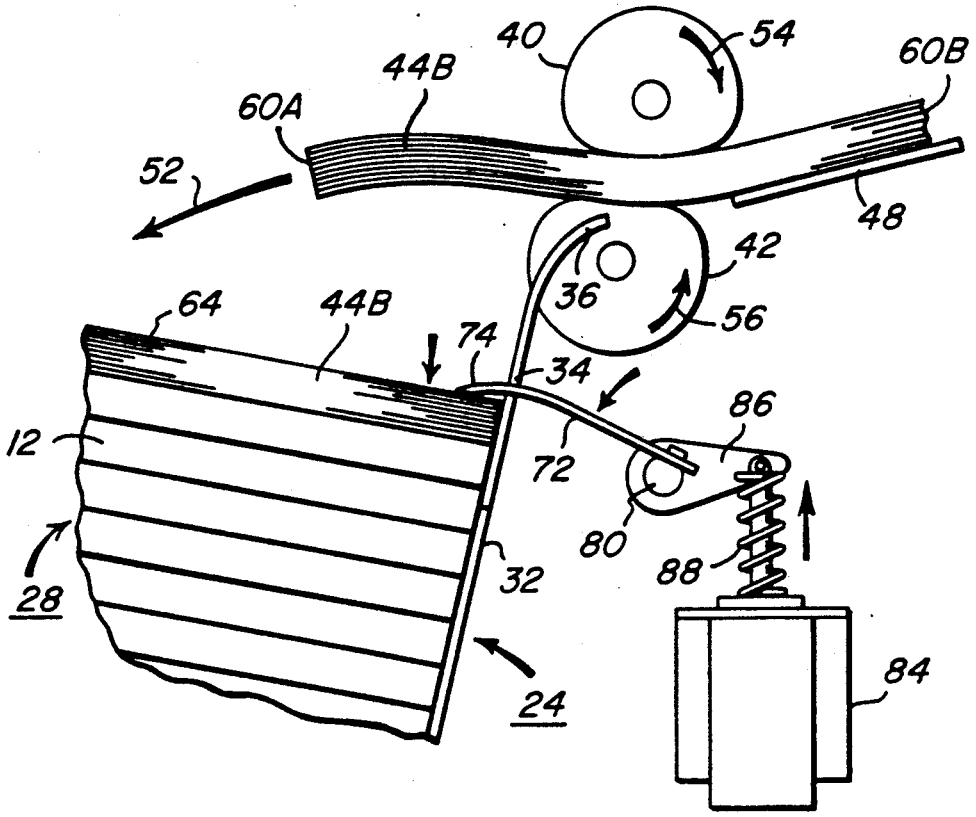

Apparatus 20 also includes means, such as a pair of oppositely rotating pinch rollers 40, 42, for feeding a new set 44B of sheets traveling in the direction of the arrow 46 along a sheet travel and support path 48. The feed rollers 40, 42 are each located on rotatable axes 50A, 50B so as to both form a nip 62 and a sheet feed path 52 (see FIG. 1B) that lies above the top 36 of the stop or wall 32. As supported, rollers 40 and 42 are drivable by suitable means (not shown) in the direction of arrows 54, 56. As shown, for example in FIGS. 1A and 1D, rollers 40, 42 are compliant, and normally are in contact with each other when not feeding a set of sheets. However, these rollers, as shown in FIGS. 1B and 1C, can be compressed and separated to the extent of the thickness of the set being fed during the feeding of such set into the hopper 24, for example, the new set 44B. To completely feed a sheet or a set of such sheets, the rollers 40, 42 engage the leading edge 60A of the sheet or set in the nip 62, and then drive such sheet or set through the nip 62 until the trailing edge 60B of the sheet or set is completely discharged from the nip.

Figure 1D:
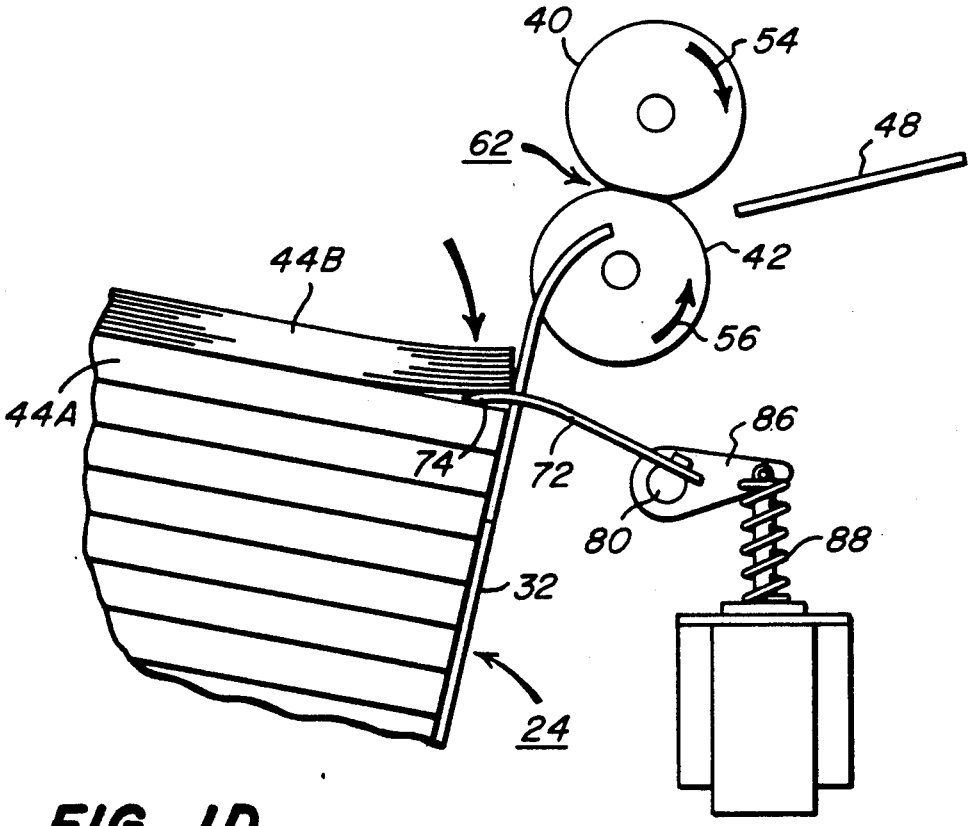

The apparatus 20 also includes means for sensing both the leading edge 60A and trailing edge 60B, for example, of the new set 44B being fed by the rollers 40, 42. Such sensing means can be associated with the contact and separation features of the rollers 40, 42, and should be capable of sensing the approach of the leading edge 60A into the nip 62. In addition, such sensing means should also be capable of sensing the exiting or complete discharge of the trailing edge 60B from the nip 62 (FIG. 1D).

In operating the apparatus 20, there ordinarily is a tendency for the leading edge 60A of the set 44B being fed (see FIG. 1C) to drop into contact with the top sheet 64 of the top set 44A of the stack, long before the trailing edge 60B of such set 44B is completely discharged from the nip 62. As such, the leading edge 60A will be forced to frictionally slide over the rest of the top sheet 64 until the trailing edge 60B is so discharged. The result often is an undesirable dishevelment, tearing or other damaging of the top sheet 64, as well as, of the next several sheets immediately below such top sheet 64. The problem with such dishevelment and tearing is especially acute where the lead edge of the top set, for example, set 44A in the stack, is the edge that was stapled or bound to form such set. This usually means that the trail edge 90B is loose, and any force tending to push the top sheet towards the lead edge will certainly dishevel such top sheet. Conventionally, attempts to avoid this problem normally include the use of forwardly tilting hoppers with lead edge stops which must be adjusted for accommodating different size sheets.

In the present invention, however, in order to prevent such dishevelment, tearing or other damaging, the apparatus 20 includes an anti-dishevelment device generally designated 70. The device 70 is connected to the means for sensing both the leading and trailing edges 60A, 60B of the set, for example, 44B being fed by rollers 40, 42 onto the stack in the hopper. The device 70 functions to prevent such dishevelment, tearing and other damage by continuously and firmly holding down the trailing edge 90B of the top sheet 64 of the top set 44A of the sets already in the stack, during the entire feeding of the new set 44B onto the stack, as shown in FIGS. 1C and 1D. As such, sets of different size sheets can be effectively fed in a horizontal direction, or even into a backwardly tilted hopper by sliding the leading edge of the feeding set 44B as far as is necessary on the top sheet 64 being held down, without disheveling or otherwise damaging such top sheet.

As shown, the device 70 includes a finger 72 that has a curved first end 74 which can contact the top sheet 64 of the top set 44A in the stack, and a second end 76 which is coupled to a rotatable shaft 80. The shaft 80 is supported outside of the hopper 24, and parallel to the stop or wall 32 at or slightly above the bottom 38 of the slots 34 in the wall 32. It is preferable that the device 70 include a plurality of such fingers 72, appropriately spaced from one side to the other of the wall 32 so as to enable each finger 72 to fit operatively within each slot 34. Each finger 72 will thus be capable of being moved between a down-position as shown for examples in FIGS. 1A, 1C and 1D, where the first end 74 contacts and is firmly urged against the top sheet of the top set in the stack, and an up position, as shown in FIG. 1B, where the first end 74 is moved upwards and away from the stack 28, in preparation for a return to its down-position. In such movement, the first end 74 of the finger 72 is capable of moving substantially out of the hopper 24, as well as, downward within the slot 34 to the bottom 38 of the slot 34, depending on the height of the slack 28 already within the hopper 24.

For moving the finger 72 between its up and down positions, the device 70 includes a solenoid 84 that is connected to a rocker arm 86. The rocker arm 86 is attached to the rotatable shaft 80 such that when the stroke of the solenoid is fully extended (FIGS. 1A, 1C and 1D) the finger 72 will be in its down-position, and such that when the stroke is fully retracted, the first end 74 of the finger 72 will be in its up-position, substantially out of the hopper 24. As shown in FIGS. 1A and 1B, when the solenoid 84 is energized its stroke will be retracted as described above (FIG. 1B), and when it is de-energized (FIG. 1A) its stroke will be free to be extended as described above.

For extending the stroke of the solenoid 84 as such, and for firmly urging the first end 74 of the finger 72 against the top sheet 64 of the top set 44A in the stack, the device 70 further includes a spring 88. The spring 88, as shown, can be compression spring that is mounted so that it normally pushes upwardly on the rocker arm 86, thereby rotating the shaft 80, for example, counterclockwise, and thereby causing the first end 74 of the finger 72 to press firmly against the top sheet 64 of the top set 44A in the stack. Energizing the solenoid 84 acts against this normal tendency of the spring 88, further compressing the spring, as shown by the arrow 89 (FIG. 1B). The spring 88, of course, will return to its normal position, as above, once the solenoid 84 is de-energized. As such, operation of the device 70 requires relatively little electrical power.

Operatively, FIG. 1A shows a stack 28 of sets 12 of sheets already in the hopper 24. The finger 72 is in its down-position from the last feeding of a set, (currently the top set 44A of the sets in the stack 28 in the hopper). A new set 44B moving down the sheet travel path 48 is approaching the nip 62 of the feed rollers 40, 42, and is therefore ready to be received and stacked by the apparatus 20. The leading edge 60A of the new set 44B can therefore be sensed by the sensing means associated with the feed rollers 40, 42. Such sensing by the sensing means can be utilized to activate the rotation of the feed rollers, and to reset the finger 72 by moving it from its down-position to its up-position, and back to its down-position, as shown in FIGS. 1B and 1C.

To reset the finger 72 as such, the solenoid 84 is first energized, thereby compressing the spring 88 and lifting the first end 74 of the finger, upwards and away from the stack 28 until the end 74 is substantially out of the hopper 24. As shown in FIG. 1B, such movement of the end 74 will slightly lift the trail edge 90B of the top set 44A of the stack, and then allow such edge to fall back fully on the stack adjacent the back stop or wall 32, during the time the finger 72 is still in its up-position. Thereafter, the solenoid 84 is de-energized.

De-energizing the solenoid 84 will allow the spring 88 to reposition the finger 72 in its down-position, and to thereby resume urging the first end 74 of the finger 72 against the trail edge of the top sheet 64 of the top set 44A of the sets in the stack. Care should be taken to adjust the rate of feed of the new set 44B by the rollers 40, 42 to be such that the finger 72 is completely and fully reset, as described above, before the leading edge 60A, of the new set 44B being fed, touches down on the top sheet 64 of the top sheet 44A. Once reset as such, the finger 72 will be held in its down-position firmly urged against the trail edge 90B of the top sheet 64 of the top set 44A until the trailing edge 60B of the new set 44B is completely discharged by the rollers 40, 42 into the hopper 24, as shown in FIG. 1D. In this manner, the new set 44B will be received and stacked on top of the other sets in the stack 28 with the trail edge 60B adjacent the back stop or wall 32, regardless of the size of the sheets making up the set, and without disheveling, tearing or otherwise damaging the top sheet 64 of the top set 44A.

Figure 2:
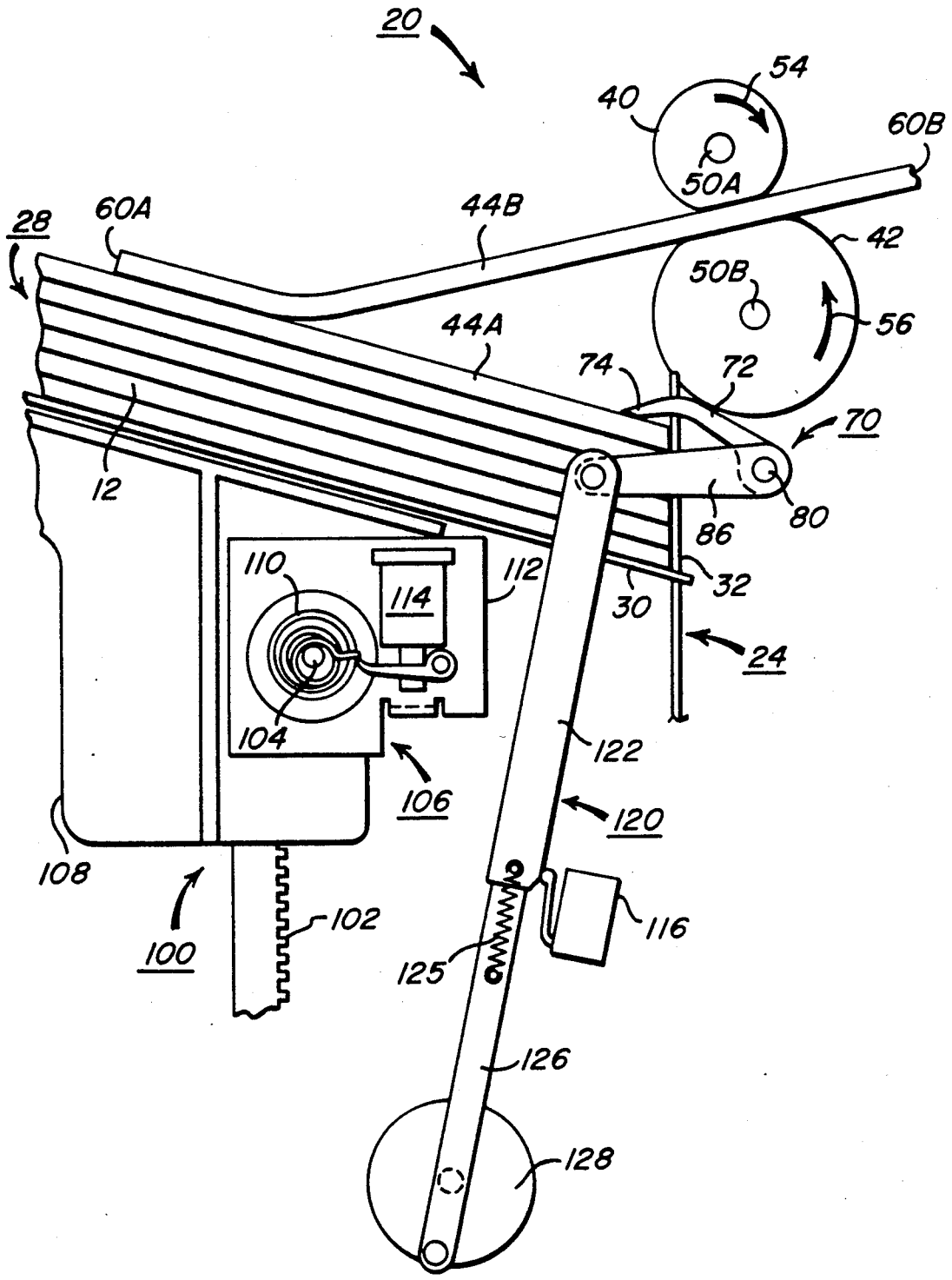
FIG. 2 is a partial schematic side view of the apparatus of the present invention showing the anti-dishevelment device and means for downwardly indexing the receiving member.

As each new set 44B is fed thus onto the stack, the height of the stack, and hence the position of the top sheet of each top set of the stack, will gradually increase upwards, relative to the position of the shaft 80, and relative to the walls, for example, wall 32, of the hopper 24. In order to maintain the effectiveness of the apparatus 20 in feeding and stacking new sets of sheets as above, a second embodiment of the apparatus 20 is shown in FIG. 2 including means 100, for indexably moving the receiving member, such as the hopper 24, downward in response to the increasing height of the stack in the hopper. As shown, such means 100 may include a rack 102 and pinion 104 assembly 106 which is connected to, and is capable of movably carrying, the hopper 24 up and down, thereby changing the position of the top sheet of the top set in the stack 28 in the hopper, relative to the position of the anti-dishevelment device 70.

The rack and pinion assembly 106 further includes a carriage 108 which slides up and down on the rack 102 causing the pinion shaft 104 to wrap and unwrap a torsion spring 110. The torsion spring 110 is useful for lifting the hopper, when the hopper is empty, and it therefore needs only enough strength to lift the weight of the empty hopper. Such use of a spring again reduces power requirements for the apparatus of the present invention. Attached to one end of the pinion shaft 104 is a brake 112 consisting of a wrap spring clutch (not shown) that is attached to a solenoid 114. When the solenoid 114 receives a voltage signal, the wrap spring in the wrap spring clutch unwinds a little, thereby releasing its hold on the pinion shaft 104, and thereby allowing the hopper 24 to indexably drop until stopped by the action of the brake 112. To activate the braking action of the brake 112, the voltage signal to the solenoid 114 is removed, causing the wrap spring of the clutch to quickly wrap down on the pinion shaft 104, thereby stopping it from rotating any further. The brake is therefore a "power off" type brake.

The voltage signal for operating the brake 112 as such, is taken from a microswitch 116 which is additionally used for sensing the position of the top sheet of the top set 44A of the stack in the hopper 24. The microswitch 116 is attached to the anti-dishevelment device 70 via an extendable linkage assembly 120. The linkage assembly 120 includes a top link 122 that is connected slidably by a spring 125 to a bottom link 126, and fixedly to the rocker arm 86 of the device 70. As described above, the rocker arm 86 can be moved to rotate the shaft 80, thereby moving the finger 72 between its down-position and its up-position. As shown, the rocker arm 86 is moved by means of a crank 128 that is connected to the base of the bottom link 126, and that is driven, for example, by means of a single revolution clutch (not shown). In this second embodiment of the apparatus 20, the rotation of the crank 128 is responsively tied to the means for sensing the leading and trailing edges of a set being fed by the feed rollers 40, 42.

Operatively, as each new set 44B enters the hopper 24, the anti-dishevelment device 70 is actuated, and its finger 72 is reset, as above, so that it comes to rest on the trail edge of the top sheet of the top set of the stack in the hopper. With each such repositioning or resetting of the finger 72, the extendable linkage assembly 120 gets longer. When it has been sufficiently lengthened, it will close the contacts of the microswitch 116 and thereby provide a voltage signal to the solenoid 114 which is connected to the brake 112. This will cause the carriage 108 and the hopper 24 to begin to drop. As the hopper drops, the finger 72 will follow the top of the stack 28 downward due to the preloading of the compression spring 125 in the extendable linkage assembly 120. As the finger 72 descends, the linkage assembly 120 will get shorter until it is short enough so as to cause the contacts of the microswitch 116 to open, thereby cutting off the voltage signal to the solenoid 114, and thus operating the brake 112 and preventing the hopper 24 from dropping any further. The movement of the hopper in this manner is depended only on the relative position of the extendable linkage assembly, and hence independent of the weight of the sheets in the stack. The apparatus 20 therefore can also handle sheets of different weights. Operated in this manner, the second embodiment of the apparatus 20 will act to maintain a substantially constant position for the top of a stack 28 of sets in the hopper 24, while simultaneously also maintaining positive pressure on the stack by means of the anti-dishevelment finger 72.

An important advantage of the means 100 for indexing the hopper 24, is that is is completely independent of the weight of the stack in the hopper, as well as, of the size of paper entering the hopper. When the stack is completely removed by an operator, the empty hopper will return to its highest position due to the torque supplied by the torsion spring 110 on the rack and pinion assembly 106. The indexing system therefore requires very little power to lift the hopper. Additionally, the brake 112 is a "power off" type brake, which means that the brake is on when the power is off. The only power needed to operate it is only a brief pulse to the small solenoid 114. Furthermore, the anti-dishevelment finger 72 is also triggered only by the small solenoid 84, which in the second embodiment, may be connected to the single revolution clutch that drives the crank 128.

Other advantages of the apparatus 20 include the fact that the anti-dishevelment device 70 works on the trail edge 90B of the top set 44A of the top set in the stack, and therefore enables the apparatus 20 to handle sheets of different sizes against a common back stop 32 without the need for an adjustable stop.

Although the detailed description of the apparatus of the present invention has been made with particular reference to preferred embodiments, it will be understood that the variations and modifications thereof can be effected within the spirit and scope of the invention.

What is claimed is:

1. In an electrostatographic copier or printer, apparatus for feeding and stacking sets of sheets, the apparatus including:

(a) a receiving member for receiving and holding a stack of such sets including means for moving said receiving member downward in response to each new set so fed and stacked;

(b) means for feeding a plurality of such sets one at a time onto the top of the stack in said receiving member; and (c) an anti-dishevelment device for preventing the tearing, dishevelment and other damaging of the top sheet of the top set in the stack by contacting an holding down such top sheet during the feeding of a new set onto the stack.

2. The apparatus of claim 1 wherein said anti-dishevelment device includes a finger for contacting the top sheet of the stack in said receiving member, and means for urging said finger against such top sheet during the feeding of a new set onto the stack.

3. The apparatus of claim 1 wherein said anti-dishevelment device further includes:

(a) a curved finger having a first end for contacting the top sheet of the top set of the stack in said receiving member, and a second end coupled to a rotatable shaft;

(b) means for urging said first end of said finger against such top sheet so as to hold down the stack and such top sheet; and (c) means for rotating the shaft to move said first end of said finger between a down-position wherein said finger firmly holds down such top sheet and the stack during the feeding of a new set, and an up-position wherein said first end of said finger is moved away from such top sheet.

4. The apparatus of claim 2 wherein said means for urging said finger against such top sheet is a spring.

5. The apparatus of claim 3 wherein said means for rotating the shaft includes a solenoid and rocker arm assembly connected to the shaft.

6. The apparatus of claim 3 wherein said anti-dishevelment device includes a plurality of said curved fingers.

7. The apparatus of claim 1 wherein said means for feeding such a plurality of sets includes means for sensing both the leading edge and the trailing edge of each new set being fed thereby.

8. The apparatus of claim 7 wherein said means for sensing the leading and trailing edge is connected to said anti-dishevelment device such that said finger of said anti-dishevelment device continuously holds down the top sheet of such top set between a time shortly after said sensing means senses the approach of the leading edge of a new set being fed, and a time when said sensing means senses the exiting or complete discharge by said feeding means of the trailing edge of such new set.

9. The apparatus of claim 1 wherein said means for moving said receiving member includes:

(a) a rack and pinion assembly connected to, and movably carrying, said receiving member, for moving said receiving member up and down;

(b) a extendable linkage assembly connected to said anti-dishevelment device, said linkage assembly changing its position in response to newly fed and stacked sets raising the position of the top sheet of the top set in the stack in said receiving member; and (c) a microswitch associated with said linkage assembly for sensing the changing position of said linkage assembly, and for causing said rack and pinion assembly to move said receiving member downwards responsively to such changes in the position of said linkage assembly.

10. Apparatus for feeding and stacking finished sets of sheets, the apparatus comprising:

(a) a hopper for receiving and holding such sets in a stack, said hopper having a front end, a back end opposite said front end, and a stop extending upwardly at said back end against which sets of various size sheets are stackable;

(b) means for feeding such sets one at a time from above said stop into said hopper such that the leading edge of the set being fed engages and slides over the top sheet of the top set already in the stack, and such that the trailing edge of such set ends up adjacent said stop regardless of the size of the sheets; and (c) an anti-dishevelment device for preventing dishevelment and damage to the top sheet of the top set in the stack due to said leading edge sliding thereon, said device including a finger for holding down the trail edge of the top sheet of the top set in the stack in said hopper during the feeding of a new set onto the stack, and means for urging said finger against such trailing edge of such top sheet.

11. The apparatus of claim 10 wherein said back end of said hopper is lower than said front end of said hopper.

12. In an electrostatographic copier or printer, apparatus for feeding and stacking sets of bound sheets, the feeding apparatus including:

(a) a receiving member for receiving and holding a stack of such bound sets;

(b) means for feeding a plurality of such sets one at a time onto the top of the stack in such receiving member; and (c) an anti-dishevelment device for preventing the tearing, dishevelment and other damage of the top sheet of the top set in the stack due to the leading edge of a new set being fed onto the stack sliding on such top sheet, said anti-dishevelment device including a finger for contacting and holding down such top sheet of the top set before such leading edge of the next set being fed touches down on such top sheet, and until the trailing edge of the new set being fed is completely discharged onto the stack.

* * * * *